US007547075B2

(12) United States Patent
Tewes et al.

(10) Patent No.: US 7,547,075 B2
(45) Date of Patent: Jun. 16, 2009

(54) FIXING DEVICE FOR A SHANK CHISEL

(75) Inventors: Günter Tewes, Unkel/Rhein (DE); Jochen Blens, Kall-Scheuern (DE); Bernd Holl, Neustadt/Wied (DE)

(73) Assignee: Wirtgen GmbH, Windhagen (DE)

( * ) Notice: Subject to any disclaimer, the term of this patent is extended or adjusted under 35 U.S.C. 154(b) by 247 days.

(21) Appl. No.: 11/578,889

(22) PCT Filed: Mar. 10, 2005

(86) PCT No.: PCT/EP2005/002513

§ 371 (c)(1),
(2), (4) Date: Oct. 19, 2006

(87) PCT Pub. No.: WO2005/100748

PCT Pub. Date: Oct. 27, 2005

(65) Prior Publication Data

US 2007/0241605 A1 Oct. 18, 2007

(30) Foreign Application Priority Data

Apr. 19, 2004 (DE) ..... 10 2004 019 383

(51) Int. Cl.
*E21C 35/19* (2006.01)

(52) U.S. Cl. ..... 299/106; 299/85.2

(58) Field of Classification Search ..... 299/106, 299/85.2

See application file for complete search history.

(56) References Cited

U.S. PATENT DOCUMENTS

| | | | | |
|---|---|---|---|---|
| 4,609,227 | A | 9/1986 | Wild et al. | |
| 4,915,455 | A | 4/1990 | O'Neill et al. | |
| 5,011,229 | A | 4/1991 | O'Neill et al. | |
| 6,619,756 | B1 * | 9/2003 | Holl et al. | 299/85.2 |

FOREIGN PATENT DOCUMENTS

| | | |
|---|---|---|
| DE | 295 10 913 U1 | 11/1995 |
| DE | 297 11 566 U1 | 9/1997 |
| EP | 0 200 037 | 11/1986 |
| EP | 0 129 883 | 3/1989 |

* cited by examiner

*Primary Examiner*—John Kreck
(74) *Attorney, Agent, or Firm*—Pauley Petersen & Erickson

(57) ABSTRACT

A fixing device for a shank chisel including a base part to which a chisel holder is attached in a manner that enables it to be exchanged. The chisel holder has a chisel location for the shank chisel and has a supporting face on which the shank chisel can be supported. The chisel holder is coupled to the base part by a pivot bearing, and the chisel holder rests against a mating face of the base part. This invention provides a stress-optimized design for the above-mentioned arrangement. Thus, according to this invention, when the chisel holder is mounted, a contact area formed between the contact face and the mating face is located between a rotation axis or a rotation path of the pivot bearing and the supporting face.

19 Claims, 3 Drawing Sheets

FIXING DEVICE FOR A SHANK CHISEL

BACKGROUND OF THE INVENTION

1. Field of the Invention

This invention relates to a device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holders rest against a counter-face of the base element by a contact face.

2. Discussion of Related Art

A device is known from German Patent Reference DE 297 11 56 U. The base element has a recessed receiver, into which a holding element of the chisel holder is introduced. The holding element has a convexly curved contact face. The counter-face of the base element is correspondingly concavely formed.

A linked seating results because of the contact face and the counter-face. This permits the mounting of the chisel holder which is pivoted into the receiver and the contact face slides along the counter-face. A shoulder of the chisel holder protrudes out of the receiver. This shoulder has a chisel receiver, in which a shank chisel can be installed. The shank chisel is supported on a support face extending in a ring shape around the chisel receiver. During the employment of the tool the forces are introduced from the shank chisel into the support face. Then, starting from the support face, the forces are transmitted into the base element via the contact face and the counter-face.

SUMMARY OF THE INVENTION

It is one object of this invention to provide a device of the type mentioned above but in which the load on the device during operations is optimized.

This object is attained if in the mounted state of the chisel holder the contact area formed between the contact face and the counter-face is arranged between an axis of rotation or path of rotation of the linked seating and of the support face.

With this arrangement, a contour of the contact face is created, which protrudes in a direction toward the chisel holder and is arched. This makes it possible to bring the support face of the chisel holder closely toward the contact area formed between the contact face and the counter-face. It is thus possible to clearly reduce tensions of the chisel holder during the employment of the tool, and thus to extend the service life of the chisel holder.

In one embodiment of this invention, in the mounted state of the chisel holder the axis of rotation or path of rotation, both called axis of rotation for short, intersects the chisel receiver of the chisel holder. Thus the chisel receiver is extended as far as into the area of the volume of the base element. For one, this makes possible a compact construction. Also, the forces can be directly introduced into the base element, which leads to a noticeable reduction of the tension.

In another embodiment of this invention, the base element has a recessed receiver, which the chisel holder engages with a holding section, and the chisel receiver is arranged at least partially in the area of or near the recessed receiver. Thus, it is possible to arrange the support face for the chisel receiver closely toward the surface of a cutting roller, on which the base element is customarily mounted. Thus, it is also possible to create small cutting circle diameters. This is a particular advantage in connection with fine milling during road construction operations.

The tool holder is of a simple design, which is also simple to produce, if the chisel holder has a concave linkage section, which works together with a convex linkage section of the base element for forming the linked seating.

It is possible to realize a compact construction if the chisel holder has a holding section which forms the chisel receiver. A shoulder is formed transversely with respect to the center longitudinal axis of the chisel receiver, which laterally adjoins the holding section and supports the linkage section. A shoulder is respectively symmetrically arranged on both sides of the holding shoulder with respect to the center longitudinal axis of the chisel receiver, each of which has a linkage section, wherein both the linkage sections form a common pivot shaft. The tension-optimized layout of the tool can be further improved if in the mounted state of the chisel holder, an axis of rotation of the linked seating intersects the center longitudinal axis of the chisel receiver.

In one embodiment of this invention, the base element has a fastening section, by which it can be attached to a rotatory body of a milling machine. A connecting shoulder, which supports the linkage section, adjoins the fastening section, and the chisel holder covers the connecting shoulder, at least partially, on a side facing away from the fastening section by a cover. The cover protects the base element against wear caused by the abrasive material removed during the cutting/milling process.

In one embodiment of this invention, the mounted state a seating face of the chisel holder rests against a detent on the base element. Adjoining the seating face and facing away from the linked seating the chisel holder has a fixation element with a screw receiver. The fixation element is spaced apart from a fastening shoulder of the base element, and the chisel holder is clamped together with the fastening shoulder of the base element by a fastening screw passing through the screw receiver. The spaced-apart arrangement of the fixation element in regard to the linked seating constitutes or forms a large fastening lever, which makes possible a secure fixation in place of the chisel holder on the base element.

A clamping area is formed because the fixation element is spaced apart from the fastening shoulder. For one, this compensates tolerances of measurement. Furthermore, dependable clamping is possible.

In this connection, the base element can have a receiver in the area of or near the fastening shoulder, in which a nut is received, fixed against relative rotation. The nut can be aligned with an opening of the fastening shoulder and of the screw receiver of the fixation element of the chisel holder. The nut can also be embodied or formed as a standard nut. In case of wear, the nut can be easily and rapidly replaced.

BRIEF DESCRIPTION OF THE DRAWINGS

This invention is explained in view of an exemplary embodiment represented in the drawings, wherein.

DETAILED DESCRIPTION OF THE INVENTION

Figure 1:
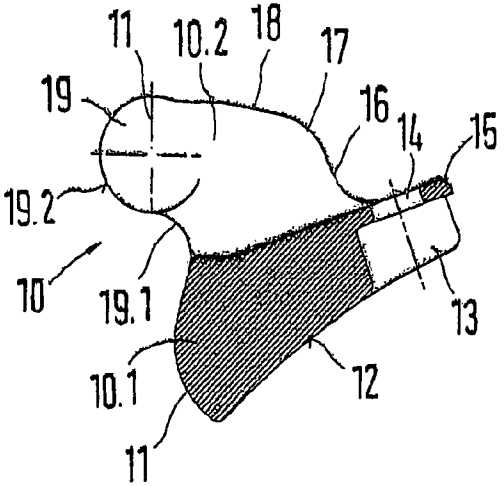
FIG. 1 shows a base element in a side view from the right and in section.
Figure 2:
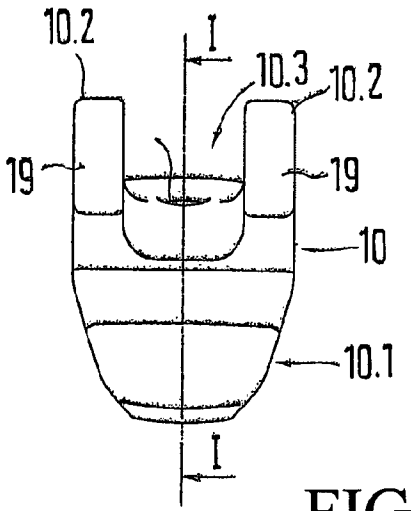
FIG. 2 shows a base element in accordance with FIG. 1, in a view from the front.
Figure 3:
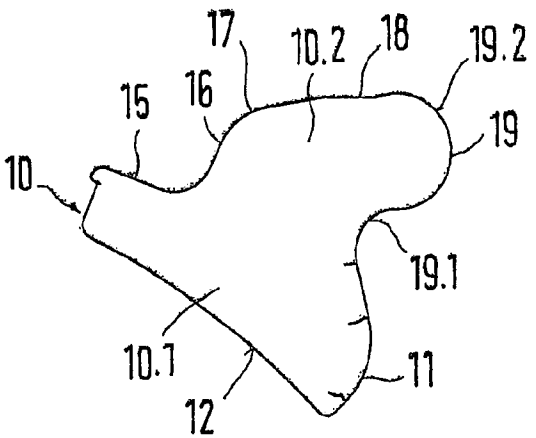
FIG. 3 shows the base element in accordance with FIG. 1, in a side view from the left.
Figure 4:
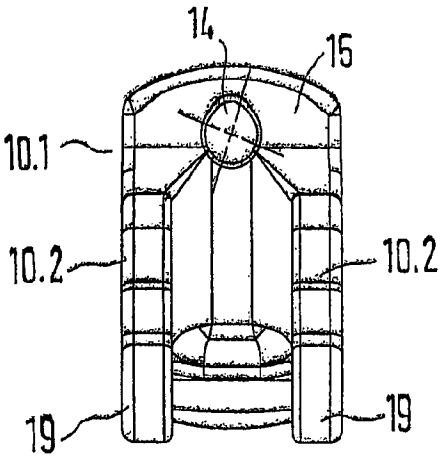
FIG. 4 shows the base element in accordance with FIG. 1, in a view from above.

A base element 10 of a device for holding a shank chisel 30 is shown in FIGS. 1 to 4. The base element 10 has a fastening section 10.1 with a placement face 12. The placement face 12 has a concavely curved contour, to which the curvature of a cylindrical outer contour of a milling roller is matched. The base element 10 can be placed with the placement face 12 on the milling roller and connected with it, for example welded to it. In a rear area, the fastening section 10.1 has a receiver 13 open toward an underside of the base element 10, so that it can be easily produced, for example by a cut out by machining. In its cross-sectional shape the receiver 13 is laid out so that a nut can be introduced through the open rear of the receiver 13. The circumferential contour of the nut lies, secured against being twisted, in the receiver 13. The threaded portion of the nut is accessible through an opening 14 in a fastening shoulder 15 of the base element 10. In the area of or near the front of the base element 10 the connecting shoulder 10.2 is closed off by a convexly rounded front element 11. As FIG. 2 shows, two plate-shape connecting shoulders 10.2 are formed on the fastening section 10.1. The connecting shoulders 10.2 are arranged in parallel and spaced apart from each other and define a receptacle 10.3 that has been cut into the base element.

Starting from the fastening shoulder 15, the connecting shoulders 10.2 transition via a wall 16 into a convexly arched transition section 17. The base element 10 has a detent 18 adjoining the transition section 17. The detent 18 transitions into a linkage section 19.2 of a convex outer contour, which is embodied or formed as a counter-face 19.1. The linkage section 19 has a form of a partial cylinder, which in this case extends over an arc of 180°. At the front, the linkage section 19 makes a transition by its counter-face 19.1 via a concave indentation into the front element 11.

A chisel holder 20, which can be installed in the above described base element, is shown in FIGS. 5 to 9.

The chisel holder 20 has a holding section 22, into which a cylindrical chisel receiver 28 is inserted. On one side, the chisel receiver 28 makes a transition via an insertion widening 28.1 into a ring-shaped support face 26. The support face 26 encircles the chisel receiver 28. At the end facing away from the support face 26, the chisel receiver 28 terminates in an ejection opening 29. An ejection tool can be inserted into the ejection opening 29 in a customary way for disassembling the shank chisel 30.

Figure 8:
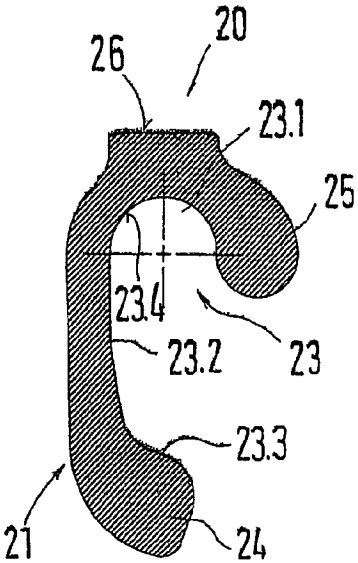
FIG. 8 shows the chisel holder in accordance with FIGS. 5 and 6, along a section line identified by line VIII-VIII in FIG. 6.
Figure 7:
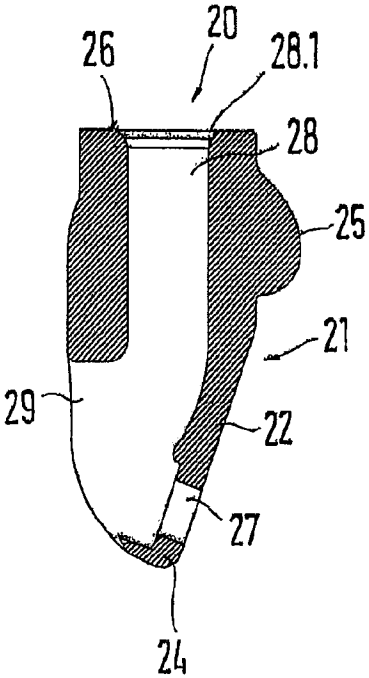
FIG. 7 shows the chisel holder in accordance with FIGS. 5 and 6, along a section line identified by line VII-VII in FIG. 6.
Figure 6:
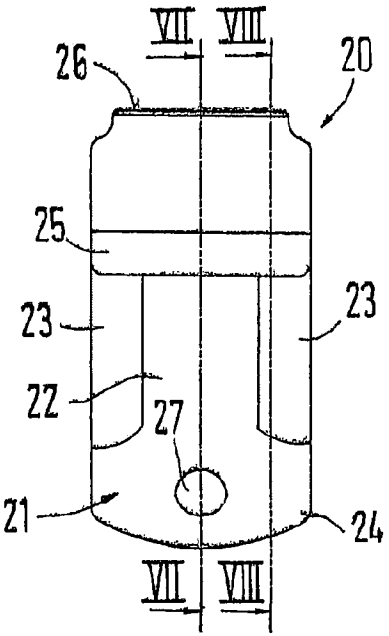
FIG. 6 shows a chisel holder in accordance with FIG. 5, in a view from below.
Figure 5:
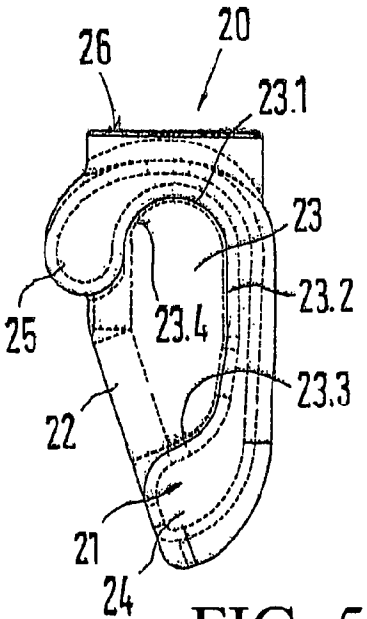
FIG. 5 shows a chisel holder in a side view from the left.
Figure 9:
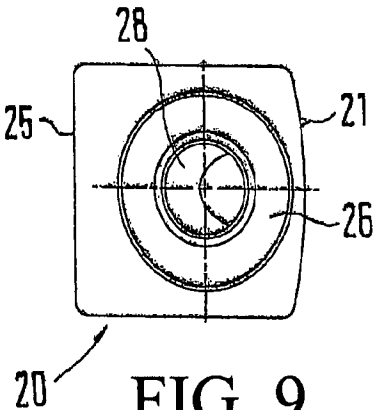
FIG. 9 shows the chisel holder in accordance with FIG. 5, in a view from the front.

A cover 21 extends on both sides of the holding section 22 transversely to the center longitudinal axis of the chisel receiver 28. The covers 21 each enclose a receiver 23. In its front area, the cover 21 is limited by a partially cylindrical, concave contact face 23.4, wherein the curvatures of the contact faces 23.4 are matched to the curvature of the counter-face 19.1 of the base element 10. The chisel holder 20 forms a linkage section 23.1 in the area of the contact face 23.4. Toward the rear of the chisel holder 20, the contact face 23.4 makes a transition into a level seating surface 23.2 that transitions into an inclined wall 23.3. The wall 23.3 is formed by a fixation element 24. As FIG. 6 shows, the fixation element 24 of the chisel holder 20 extends transversely with respect to the center longitudinal axis of the chisel receiver 28 over the entire width of the chisel holder 20. A screw receiver 27 is cut into the fixation element 24. As FIG. 8 shows, the fixation element 24 and a bulge 25 at the front define introduction openings, through which the receivers 23 are accessible.

Figure 10:
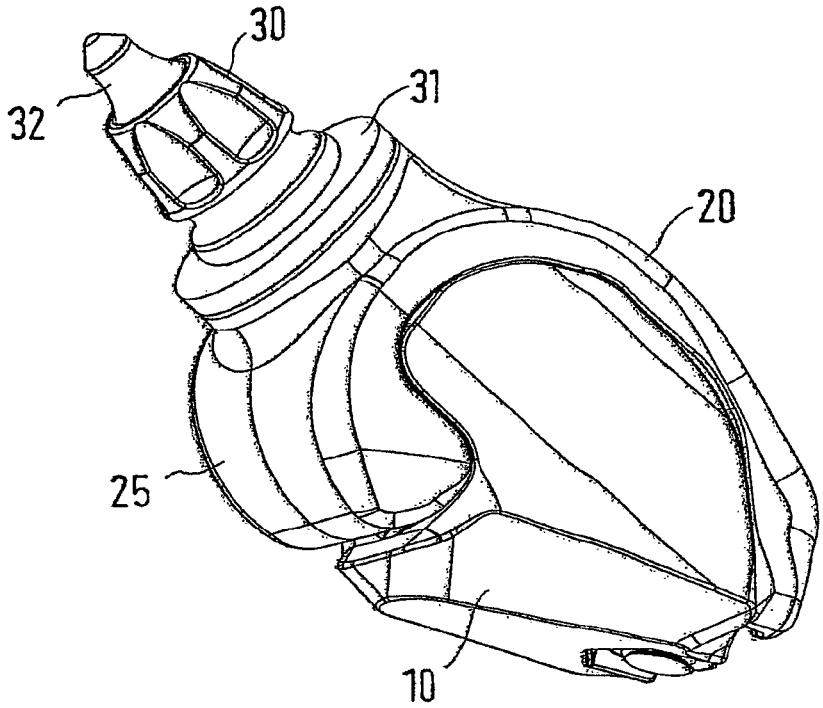
FIG. 10 shows a tool arrangement with a base element in accordance with FIGS. 1 to 4, as well as a chisel holder in accordance with FIGS. 5 to 9, in perspective views from the front.
Figure 11:
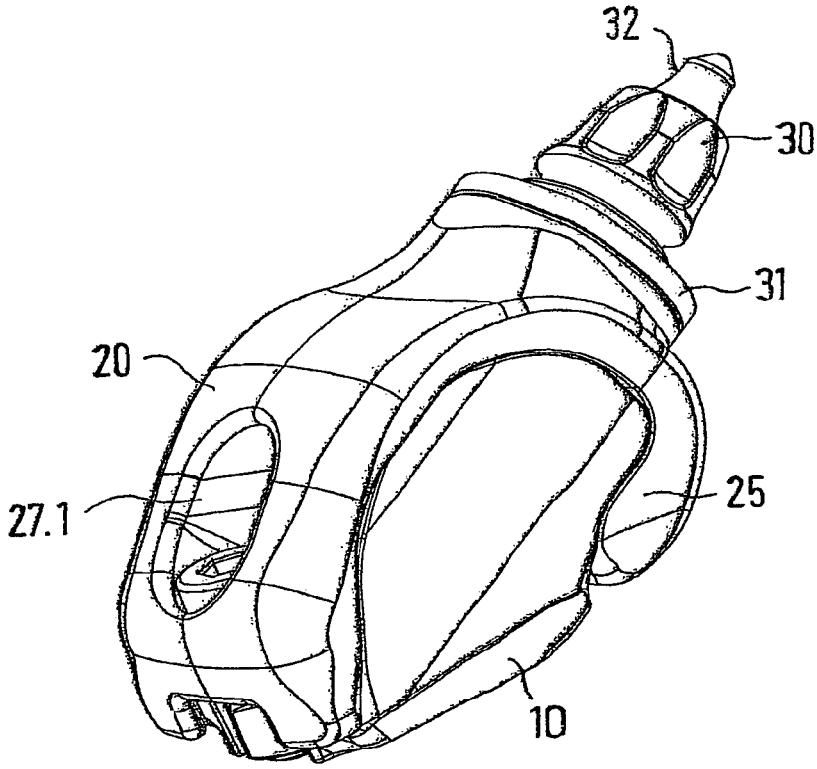
FIG. 11 shows the tool arrangement in accordance with FIG. 10, in a perspective view from the rear.

The manner of proceeding for mounting the chisel holder 20 on the base element 10 is described in view of FIGS. 10 and 11.

Initially, the chisel holder 20 is inserted with a holding shoulder into the receiver 13 in the area between the connecting shoulders 10.2. During this, the connecting shoulders 10.2 engage the receivers 23, until the linkage sections 19 and 23.1 come into engagement. The linkage sections 19 and 23.1 constitute or form a linked seating, around which the chisel holder 20 can be pivoted with respect to the base element 10. In this case, the pivot axis extends through the point of symmetry identified by "M" in FIG. 1. The pivot axis extending through "M" intersects the center longitudinal axis of the chisel receiver 28. The pivot movement of the chisel holder 20 is limited by the inclined wall 23.3 of the base element 10. The wall 16 of the chisel holder 20 strikes against the latter. In this mounting position the bulge 25 engages the indentation 19.1 of the base element 10. The fixation element 24 is at a distance from the fastening shoulder 15. It is then possible to introduce a fastening screw through the screw receiver 27 and the opening 14 aligned with it and to screw it into the nut maintained in the receiver 13. Thus, the chisel holder 20 is fixed in place on the base element 10.

The screw head of the fastening screw is protectively received in a depression 27.1 in the chisel holder 20. Removal of the chisel holder 20 correspondingly occurs in a reversed mounting sequence.

As already stated, a shank chisel 30 with a shank can be inserted into the chisel receiver 28. During this, the shank chisel 30 is maintained in the chisel receiver 28 in a known manner by a clamping sleeve applied to the shank, wherein the shank chisel 30 remains freely rotatable around a center longitudinal axis. The shank chisel 30 has a chisel head with a chisel tip 32 formed on the shank. The chisel head is supported on the support face 26 by a wear-protection element embodied as a perforated disk.

The invention claimed is:

1. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), and in the mounted state of the chisel holder (20) the one of the axis of rotation and the path of rotation intersecting the chisel receiver (28) of the chisel holder (20).

2. The device in accordance with claim 1, wherein the base element (10) has a recessed receiver (10.3) which the chisel holder (20) engages with a holding section (22), and the chisel receiver (28) is arranged at least partially near the recessed receiver (10.3).

3. The device in accordance with claim 2, wherein the chisel holder (20) has a concave linkage section (23.1) which works together with a convex linkage section (19) of the base element (10) for forming the linked seating.

4. The device in accordance with claim 3, wherein the chisel holder (20) has a holding section (22) which forms the chisel receiver (28), and a shoulder is formed transversely with respect to a center longitudinal axis of the chisel receiver (28), which laterally adjoins the holding section (22) and supports the linkage section (23.1).

5. The device in accordance with claim 4, wherein a shoulder is symmetrically arranged on both sides of the holding shoulder (22) with respect to a center longitudinal axis of the chisel receiver (28), each of which has a linkage section (23.1), and the linkage sections (23.1) constitute a common pivot shaft.

6. The device in accordance with claim 5, wherein in the mounted state of the chisel holder (20) the axis of rotation of the linked seating intersects the center longitudinal axis of the chisel receiver (28).

7. The device in accordance with claim 6, wherein the base element (10) has a fastening section (10.1) attachable to a rotatory body of a milling machine, a connecting shoulder (10.2) which supports the linkage section (19) adjoins the fastening section (10.1), and the chisel holder (20) covers the connecting shoulder (10.2) at least partially on a side facing away from the fastening section (10.1) by a cover (21).

8. The device in accordance with claim 7, wherein in the mounted state a seating surface (23.3) of the chisel holder (20) rests against a detent (18) on the base element (10), adjoining a second seating surface (23.2) and facing away from the linked seating, the chisel holder (20) has a fixation element (24) with a screw receiver (27), the fixation element (24) is spaced apart from a fastening shoulder (15) of the base element (10), and the chisel holder (20) is clamped together with the fastening shoulder (15) of the base element (10) by a fastening screw passing through the screw receiver (27).

9. The device in accordance with claim 8, wherein the base element (10) has a receiver near the fastening shoulder (15) in which a nut is received and fixed against relative rotation, and the nut is aligned with an opening (14) of the fastening shoulder (15) and of the screw receiver (27) of the fixation element (24) of the chisel holder (20).

10. The device in accordance with claim 9, wherein the chisel holder (20) has a support face (26) around the chisel receiver (28), on which the shank chisel (30) is supported by a wear-protection element (31), and the linked seating is arranged in a half of an area of the chisel receiver (28) facing the support face (26).

11. A device for securing a shank chisel. having a base element on which a chisel holder is exchangeably fastened. wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), the base element (10) having a recessed receiver (10.3) which the chisel holder (20) engages with a holding section (22), and the chisel receiver (28) arranged at least partially near the recessed receiver (10.3).

12. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), and the chisel holder (20) having a concave linkage section (23.1) which works together with a convex linkage section (19) of the base element (10) for forming the linked seating.

13. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), the chisel holder (20) having a holding section (22) which forms the chisel receiver (28), and a shoulder formed transversely with respect to a center longitudinal axis of the chisel receiver (28) which laterally adjoins the holding section (22) and supports a linkage section (23.1) of the chisel holder (20).

14. The device in accordance with claim 13, wherein a shoulder is symmetrically arranged on both sides of the holding shoulder (22) with respect to a center longitudinal axis of the chisel receiver (28), each of which has a linkage section (23.1), and the linkage sections (23.1) constitute a common pivot shaft.

15. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), and in the mounted state of the chisel holder (20) the axis of rotation of the linked seating intersecting the center longitudinal axis of the chisel receiver (28).

16. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), the base element (10) having a fastening section (10.1) attachable to a rotatory body of a milling machine, a connecting shoulder (10.2) which supports the linkage section (19) adjoining the fastening section (10.1), and the chisel holder (20) covering the connecting shoulder (10.2) at least partially on a side facing away from the fastening section (10.1) by a cover (21).

17. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), in the mounted state a seating surface (23.3) of the chisel holder (20) resting against a detent (18) on the base element (10), adjoining the seating surface (23.2) and facing away from the linked seating, the chisel holder (20) having a fixation element (24) with a screw receiver (27), the fixation element (24) spaced apart from a fastening shoulder (15) of the base element (10), and the chisel holder (20) clamped together with the fastening shoulder (15) of the base element (10) by a fastening screw passing through the screw receiver (27).

18. The device in accordance with claim 17, wherein the base element (10) has a receiver near a fastening shoulder (15) in which a nut is received and fixed against relative rotation, and the nut is aligned with an opening (14) of the fastening shoulder (15) and of the screw receiver (27) of the fixation element (24) of the chisel holder (20).

19. A device for securing a shank chisel, having a base element on which a chisel holder is exchangeably fastened, wherein the chisel holder has a chisel receiver for the shank chisel, the chisel holder has a support face on which the shank chisel can be supported, the chisel holder is connected to the base element by a linked seating, and the chisel holder rests against a counter-face of the base element with a contact face, the device comprising:

in a mounted state of the chisel holder (20) a contact area formed between the contact face (23.4) and the counter-face (19.2) arranged between one of an axis of rotation and a path of rotation of the linked seating and of the support face (26), the chisel holder (20) having a support face (26) around the chisel receiver (28), on which the shank chisel (30) is supported by a wear-protection element (31), and a linked seating arranged in a half of an area of the chisel receiver (28) facing the support face (26).

* * * * *